United States Patent [19]

Hansel

[11] 4,121,635

[45] Oct. 24, 1978

[54] INTERLOCK SYSTEM FOR A GASOLINE DISPENSING NOZZLE

[75] Inventor: William B. Hansel, Media, Pa.

[73] Assignee: Sun Oil Company of Pennsylvania, Philadelphia, Pa.

[21] Appl. No.: 805,776

[22] Filed: Jun. 13, 1977

[51] Int. Cl.[2] ..... B65B 3/18; B65B 57/14

[52] U.S. Cl. ..... 141/207; 141/208

[58] Field of Search ..... 141/207, 198, 229, 392, 141/208, 226

[56] References Cited

U.S. PATENT DOCUMENTS

| | | | |
|---|---|---|---|
| 3,710,831 | 1/1973 | Riegel | 141/207 |
| 4,031,930 | 6/1977 | Sutcliffe et al. | 141/207 |
| 4,033,389 | 7/1977 | Hansel et al. | 141/207 |

*Primary Examiner*—Richard E. Aegerter
*Assistant Examiner*—Willis Little
*Attorney, Agent, or Firm*—J. Edward Hess; Donald R. Johnson; Paul Lipsitz

[57] ABSTRACT

A gasoline dispensing nozzle having a system for receiving vapors displaced from a motor vehicle gasoline tank being filled, and an interlock system for both preventing the dispensing of gasoline and closing the vapor receiving system until the discharge spout is properly inserted into the motor vehicle fillpipe. The interlock system includes a first valve mounted in the vapor receiving system outside the discharge spout. This first valve is opened when the nozzle is properly inserted into the fillpipe, and is interconnected with the automatic shut-off system of the nozzle so that dispensing of gasoline is permitted only when the nozzle is properly inserted into the fillpipe. The interlock system also includes a second valve which closes the vapor receiving system, thereby preventing vapors from escaping, until the nozzle is properly inserted in the fillpipe.

1 Claim, 3 Drawing Figures

INTERLOCK SYSTEM FOR A GASOLINE DISPENSING NOZZLE

CROSS REFERENCE TO RELATED APPLICATIONS

This application is related to copending applications entitled Gasoline Dispensing Nozzle With Vapor Receiving System, Ser. No. 609,760, filed Sept. 2, 1975; Attitude Valve For A Gasoline Dispensing Nozzle With A Vapor Receiving System, Ser. No. 609,761, filed Sept. 2, 1975; Interlock System For a Gasoline Dispensing Nozzle, Ser. No. 635,189, filed Nov. 25, 1975 now U.S. Pat. No. 4,011,897; and Interlock And Latching Systems For A Dispensing Nozzle, Ser. No. 656,997, filed Feb. 17, 1976 now U.S. Pat. No. 4,033,389.

BACKGROUND OF THE INVENTION

This invention relates to a nozzle for dispensing gasoline into motor vehicle fuel tanks, and more specifically relates to an interlock system to prevent the operation of the nozzle until the discharge spout of the nozzle is properly inserted into the vehicle fillpipe.

Current environmental regulations require that gasoline vapors displaced from a vehicle fuel tank during dispensing be recovered to prevent their escape into the atmosphere. As part of these requirments, it is foreseeable that an interlock system may be required to both prevent the dispensing of gasoline and the opening of the gasoline vapor recovery system until the vapor receiving system is properly in contact with the vehicle fuel tank. Even if such a requirement never materializes, it is still desirable to have such an interlock system to encourage the filling station operator to have the vapor receiving system properly in place against the fillpipe.

The prior art discloses many designs for such an interlock system. One common approach uses a mechanical linkage between the face seal of the vapor receiving system and the automatic shut-off system within the nozzle housing. This type of system tends to be rather complicated, and adds to the weight of the nozzle as well as to the cost of construction and maintenance. Other designs include a valve located within the discharge spout and connected to the vent line which leads to the automatic shut-off system in the nozzle housing. This valve is then connected to the vapor receiving system in such a manner that it is closed when the vapor receiving system is not in contact with the vehicle fillpipe, thereby preventing the dispensing of gasoline. This particular design in the prior art has a drawback in that the valve has been located in the discharge spout of the nozzle and accordingly has been exposed to the flow of gasoline through the nozzle. With this approach, both the valve and its actuating mechanism must be designed to withstand the hostile environment in which they are located.

SUMMARY OF THE INVENTION

In accordance with a disclosed embodiment, an interlock system is provided for a nozzle having an automatic shut-off system for shutting off the fuel when dispensed fuel backs up into the fillpipe. This shut-off system includes a vent line which runs along the inside of the discharge spout and has an open end at the end of the spout. During normal operation of the nozzle, the vent line is supplied with a vacuum, and when gasoline backs up in the fillpipe and covers the end of the vent line, the pressure in the vent line drops. This pressure drop is sensed, and automatically shuts off the nozzle. The interlock system is designed around this automatic shut-off system, and includes an interlock valve in the vent line. This interlock valve is maintained closed until the nozzle is properly inserted into a fillpipe. The interlock valve is coupled to the vent line at a portion of its length which extends outside of the discharge spout. Accordingly, the valve and its actuating mechanism do not have to be designed to withstand the hostile environment within the discharge spout.

Further, in the disclosed embodiment, the nozzle is a vapor recovery nozzle for receiving vapors displaced from a fuel tank during a dispensing operation, and a second interlock valve is provided for closing the vapor receiving system unless the nozzle is properly inserted in a fillpipe, thereby preventing the escape of vapors from the system when the nozzle is not in use.

DETAILED DESCRIPTION OF DISCLOSED EMBODIMENTS

Figures 1, 2, 3:
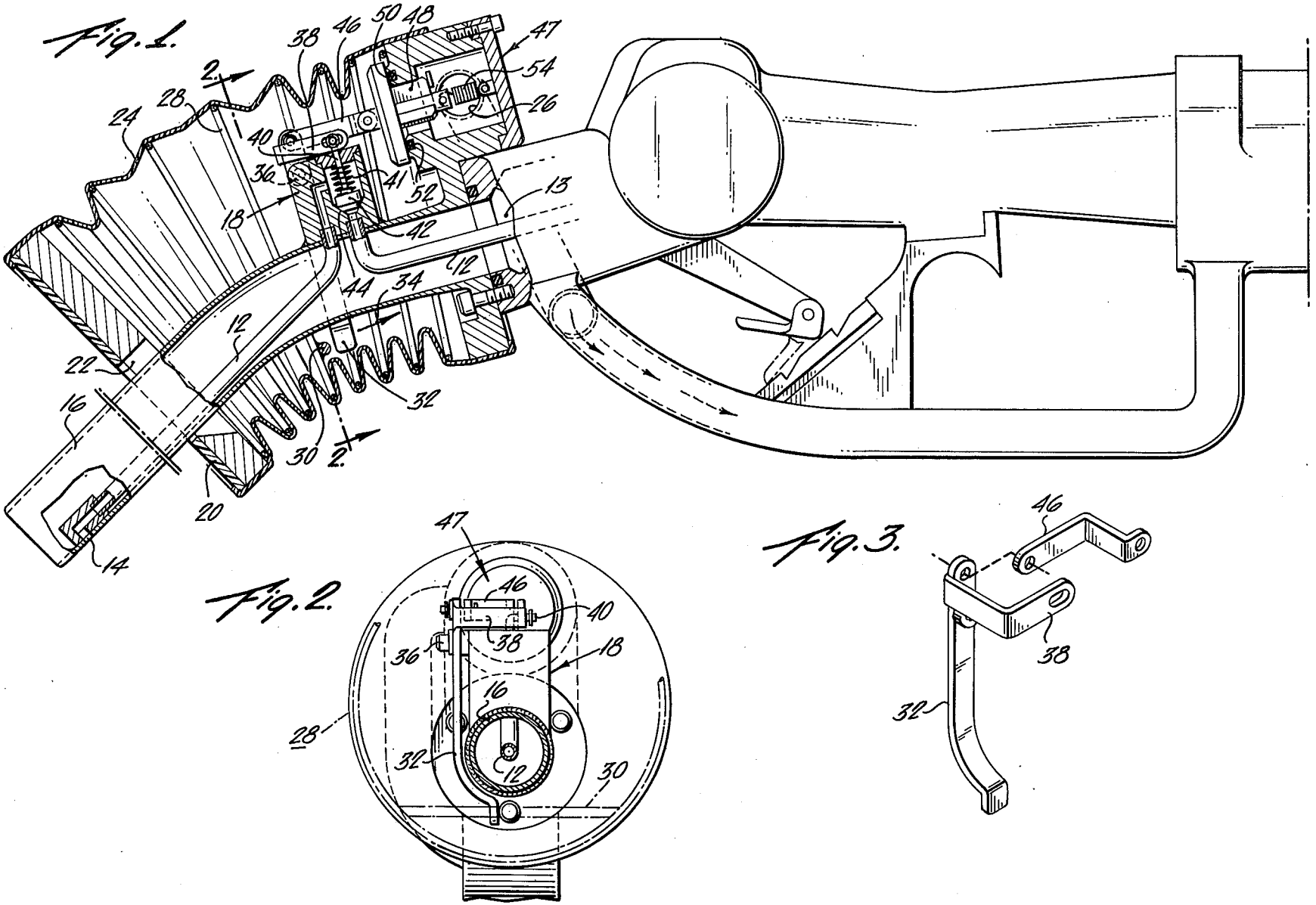
FIG. 1 illustrates a first embodiment of a vapor recovery nozzle designed in accordance with the teachings of the present invention.
FIG. 2 is a cross-section taken along lines 2—2 of FIG. 1.
FIG. 3 illustrates in expended detail a linkage for the valve system which may be utilized with the present invention.

The interlock system described herein may be used on many nozzles which are commercially available today. The disclosed nozzle is the type illustrated and explained in U.S. Pat. No. 3,734,339 issued to Young and U.S. patent application Ser. No. 635,189, filed Nov. 25, 1975 now U.S. Pat. No. 4,011,897 for INTERLOCK SYSTEM FOR A GASOLINE DISPENISNG NOZZLE, both of which documents are incorporated herein by reference. Referring now to FIGS. 1, 2 and 3, the nozzle includes a vent line 12 which has an opening 14 at the end of discharge spout 16. This vent line extends back to a chamber in the main body of the nozzle which has a diaphram positioned therein, as explained more fully in U.S. Pat No. 3,734,339. A venturi jet in the nozzle supplies vacuum to vent line 12 during a dispensing operation such that during a dispensing operation air is constantly drawn through aperture 14. When gasoline backs up into the fillpipe and covers aperture 14, air is no longer drawn into the aperture which results in a pressure drop in the vent line. This pressure drop is sensed by the diaphram in the main body of the nozzle and automatically disables the nozzle. The interlock system of the present invention is designed around this automatic shut-off system. The interlock system includes an interlock valve 18 positioned along the length of vent line 12. When valve 18 is closed, it has the same effect as if gasoline were to cover aperture 14. When interlock valve 18 is open the nozzle may be operated in a normal fashion. In accordance with the interlock system of the present invention, valve 18 is opened only when the nozzle is properly inserted into the fillpipe of a motor vehicle.

The vapor recovery system of the present invention includes a face seal 20 which seals around the motor vehicle fillpipe. An aperture 22 surrounding the discharge spout allows displaced gasoline vapors to enter a vapor recovery chamber defined by a bellows 24. Bellows 24 may be formed with a convoluted spring therein to retain its shape. Vapors travel through the bellows back to a vapor recovery passage 26 which extends back to a vapor recovery hose which eventually directs the vapors back into the underground storage tank from which gasoline is being pumped. In accordance with the disclosed embodiment a ring 28 is formed in the vapor recovery bellows. This ring may be simply one convolution of the spring referred to earlier. The ring has a cross member 30 which extends like a chord across the circular member 28 below the discharge spout. When the nozzle is not in use (as shown in the position in FIG. 1) cross-member 30 is positioned a distance from a lever arm 32. When the nozzle is inserted into a fillpipe, the face seal contacts the portion of the motor vehicle surrounding the fillpipe, and as the nozzle is pushed further into the fillpipe, chamber 24 is compressed and cross member 30 is pushed toward lever arm 32. Further insertion of the nozzle into the fillpipe causes lever arm 32 to move backward in the direction of arrow 34. Lever arm 34 is pivotally mounted about a pin 36 in interlock valve 18. Lever arm 32 includes a portion 38 which extends across the top of valve body 18 and which attaches via a rod member 40 to a valve member 42 which is normally positioned against a valve seat 44. The valve is normally spring biased closed by a spring 41 in compression. Movement of lever arm 32 in the direction of arrow 34 causes valve element 42 to lift off valve seat 44, which opens the vent line and thereby allows normal operation of the nozzle. Lever arm 32 also extends up and connects via a member 46 with a second valve 47. Valve 47 includes a valve element 48 having a zero ring 52 which normally seats against surface 50. This valve is also spring biased closed by a spring 54 in tension. Movement of lever arm 32 in the direction of arrow 34 causes the upper end of the lever arm to move in an opposite direction, and opens valve 48, thereby opening the vapor recovery passageway. From the above, it is evident that after the nozzle is inserted into a fillpipe a predetermined distance, both valves 18 and 47 will open, thereby allowing the nozzle to operate in a normal fashion. Valve 18 is attached to the top of discharge spout 16. Vent tube 12 extends from a chamber 13 in the nozzle body down through discharge spout 16, and is directed out of spout 16 to valve 18, and is then directed back into the spout to aperture 14. Accordingly, valve 18 is not exposed to gasoline being pumped, but is positioned in the vapor recovery chamber. This is a distinct advantage as valve 18 does not have to be completely sealed against liquid fuel. Further, the moving parts in the interlock system are also not subject to the flow of liquid fuel through the nozzle.

Although at least one embodiment of the present invention has been described, the teachings of this invention will suggest many other embodiments to those skilled in the art.

The invention claimed is:

1. In a vapor recovery nozzle for dispensing fuel into a fillpipe of a motor vehicle fuel tank and having a vapor receiving system for receiving vapors displaced from a fuel tank during dispensing, a system for shutting off the fuel being dispensed when fuel backs up into a fillpipe, a discharge spout for insertion into a fillpipe of a motor vehicle fuel tank, a shut-off valve for shutting off fuel being dispensed by the nozzle, and actuating means for closing said shut-off valve in response to fuel backed up into a fillpipe, the improvement of providing a vent line running inside said discharge spout having an open end at the discharge end of the discharge spout, and having a section of said vent line positioned outside said discharge spout, said vent line being supplied with a vacuum such that when gasoline covers the open end of the vent line, the pressure in the vent line drops and the pressure drop may be sensed to close said shut-off valve; and an interlock system which prevents the dispensing of liquid through the nozzle until the discharge spout of the nozzle is properly inserted in a fillpipe, and comprising an interlock valve means coupled to the vent line at said outside portion of the vent line, whereby the interlock valve means is not subject to the flow of fuel through the nozzle, said interlock valve means having a closed position wherein the vent line is closed to close said shut-off valve and an open position which permits normal operation of the nozzle, and means, responsive to the nozzle being properly inserted in a fillpipe, for opening said interlock valve means, whereby normal operation of the nozzle is permitted when the nozzle is properly inserted in a fillpipe and a second interlock valve for closing off said vapor receiving system, said second interlock valve being coupled to and actuated by said means responsive to the nozzle being properly inserted in the fillpipe.

* * * * *